US012324968B2

(12) United States Patent
Lai

(10) Patent No.: US 12,324,968 B2
(45) Date of Patent: Jun. 10, 2025

(54) GOLF BAG WITH RETRACTABLE COVER

(71) Applicant: Wei Hung Lai, Taichung (TW)

(72) Inventor: Wei Hung Lai, Taichung (TW)

( * ) Notice: Subject to any disclaimer, the term of this patent is extended or adjusted under 35 U.S.C. 154(b) by 139 days.

(21) Appl. No.: 18/299,523

(22) Filed: Apr. 12, 2023

(65) Prior Publication Data

US 2024/0042291 A1 Feb. 8, 2024

Related U.S. Application Data

(63) Continuation-in-part of application No. 17/817,583, filed on Aug. 4, 2022, now Pat. No. 12,102,896.

(51) Int. Cl.

| | |
|---|---|
| ***A63B 55/00*** | (2015.01) |
| ***A63B 55/30*** | (2015.01) |
| ***A63B 55/40*** | (2015.01) |
| ***A63B 55/57*** | (2015.01) |

(52) U.S. Cl.

CPC ..... *A63B 55/404* (2015.10); *A63B 55/40* (2015.10); *A63B 55/57* (2015.10); *A63B 55/30* (2015.10)

(58) Field of Classification Search

CPC ..... A63B 55/404; A63B 55/40; A63B 55/57; A63B 55/30; A63B 2225/09; A63B 55/406; A63B 2210/50; A63B 55/00; A63B 55/10

See application file for complete search history.

(56) References Cited

U.S. PATENT DOCUMENTS

| | | | | | |
|---|---|---|---|---|---|
| 1,770,060 | A * | 7/1930 | Barlow | A63B 55/40 | 206/315.6 |
| 5,829,719 | A * | 11/1998 | Han | A63B 55/53 | 206/315.7 |
| 5,857,567 | A * | 1/1999 | Cheng | A63B 55/57 | 206/315.7 |
| 5,860,519 | A * | 1/1999 | Meyer | A63B 55/30 | 206/315.6 |
| 5,901,845 | A * | 5/1999 | Cheng | A63B 55/40 | 206/315.7 |
| 6,062,383 | A * | 5/2000 | Han | A63B 55/57 | 206/315.3 |
| 6,315,117 | B1 * | 11/2001 | Han | A63B 55/53 | 206/315.3 |

(Continued)

*Primary Examiner* — Ernesto A Grano
*Assistant Examiner* — Symren K Sanghera
(74) *Attorney, Agent, or Firm* — Sinorica International Patent & Trademark

(57) ABSTRACT

A golf bag includes a base, a bag body, a stand and a cover. The base has a first member and a second member. The second member is pivoted on the first member to be turned between a first position and a second position. A divider is connected to the second member to be kept a predetermined distance above the bottom and moved with the second member. The bag body is connected to the base, with an annular gap formed between the bag body and the divider. The stand has two legs, which are moved between a third position and a fourth position. The cover is received in the gap between the bag body and the divider for reciprocation between a retracted position and an elevating position. Wherein, the golf bag can be switched between a straight status and a leaning status. In the straight status, the golf bag has both the first member and the second member touch the ground. In the leaning status, the golf bag has the first member and distal ends of the legs touch the ground.

14 Claims, 8 Drawing Sheets

(56) References Cited

U.S. PATENT DOCUMENTS

| | | | | |
|---|---|---|---|---|
| 6,378,581 | B1 * | 4/2002 | Sheridan | A63B 55/406 150/159 |
| 6,386,362 | B1 * | 5/2002 | Cheng | A63B 55/57 206/315.3 |
| 8,616,369 | B2 * | 12/2013 | Campbell | A63B 55/40 206/315.3 |
| 11,738,247 | B2 * | 8/2023 | Chorne | A63B 55/57 280/47.26 |
| 2002/0195360 | A1 * | 12/2002 | Hsieh | A63B 55/57 206/315.7 |
| 2007/0284022 | A1 * | 12/2007 | Hall | A63B 60/62 150/159 |
| 2010/0147713 | A1 * | 6/2010 | Huang | A63B 55/53 206/315.3 |
| 2013/0168273 | A1 * | 7/2013 | Lai | A63B 55/53 206/315.7 |
| 2014/0246345 | A1 * | 9/2014 | Zhang | A63B 60/64 206/315.4 |
| 2016/0096091 | A1 * | 4/2016 | Hennenberg | A63B 55/404 206/315.3 |
| 2017/0036079 | A1 * | 2/2017 | Lai | A63B 55/40 |
| 2018/0280772 | A1 * | 10/2018 | Logan | A63B 55/10 |

* cited by examiner

GOLF BAG WITH RETRACTABLE COVER

REFERENCE TO RELATED APPLICATIONS

This application is a Continuation-in-Part (CIP) of and claims the benefit of priority to U.S. Ser. No. 17/817,583, filed on Aug. 4, 2022, entitled "GOLF BAG WITH STAND ASSEMBLY". The entire disclosures of which is incorporated by reference herein for all purposes.

BACKGROUND OF THE INVENTION

1. Technical Field

The present invention relates to an accessory of golf club, and more particularly to a wheeled golf bag with a retractable cover.

2. Description of Related Art

In golf sport, there are many clubs for a golfer to choose to swing on a field, such as wood clubs, iron clubs, and putter. Therefore, the golfer needs to carry a dozen clubs on the field. In order to carry the clubs, golf bags are presented in the market. With the golf bag the golfer may carry clubs to play golf on a golf field.

However, carry the golf bag is an unpleasant thing since the bag is heavy and there is a long distance to walk. A wheeled golf bag is presented in the market to fix this problem. The wheeled golf bag has wheels for the golfer to drag the bag to walk on the field.

The conventional golf bag has to stand on the field by itself to wait for the golfer swinging. However, the field is not always flat, and the conventional golf bag may not stand stably on a rugged place. To fix this problem, a golf bag with stands is presented in the market. Such golf bag has two stands pivoted on the bag. The stands may be pulled out to form two of the three supports (two stands and the bottom of the bag) of the bag when the bag is put to stand on the field, and that makes the golf bag stand stably in a tilted condition.

BRIEF SUMMARY OF THE INVENTION

In view of the above, the primary objective of the present invention is to provide a golf bag with a retractable cover, which provides a stable standing status when the golf bag is put to stand by itself.

In order to achieve the objective of the present invention, A golf bag, comprising: a base having a bottom and a divider, wherein the bottom has a first member and a second member, and the second member is pivoted on the first member to be turned between a first position, in which the second member is substantially parallel to the first member, and a second position in which an included angle, which is less than 180 degrees, is formed between the first and the second members; the divider is connected to the second member of the bottom to be kept a predetermined distance above the bottom and moved with the second member; a bag body has an end connected to the bottom of the base, wherein the bag body has a flexible portion at the same side with the first member to be flexed when the second member is moved to the second position; an annular gap is formed between the bag body and the divider; a stand having two legs pivoted on the bag body, wherein the legs are moved between a third position, in which the legs are attached to the bag body, and a fourth position, in which distal ends of the legs are swung away from the bag body; wherein the golf bag is switchable between a straight status, in which the second member is moved to the first position, and a leaning status, in which the second member is moved to the second position and the legs are moved to the fourth position to have the distal ends of the legs and the first member of the bottom touching the ground; and a cover having a cylinder member and a lid, wherein the lid is connected to a top of the cylinder to be opened and closed; the cylinder member is received in the gap between the bag body and the divider for reciprocation between a retracted position, in which the lid is moved toward the bag body, and an elevating position, in which the lid is moved away from the bag body.

In an embodiment, the base further has a frame between the bottom and the divider, and the frame is connected to the divider and the second member of the bottom respectively, so that both the divider and the frame are moved with the second member.

In an embodiment, the cylinder member of the cover rests against the frame when the cylinder member is moved to the retracted position.

In an embodiment, the flexible portion of the bag body is formed between the frame and the base.

In an embodiment, the frame is connected to the second member of the bottom via a plurality of first shafts, and is connected to the divider via a plurality of second shafts.

In an embodiment, each of the second shafts is provided with a connector to be connected to the bag body.

In an embodiment, the frame is provided with a rail, and an extending member is connected to the first member of the bottom and engages the rail, so that the extending member is moved along the rail when the second member is moved between the first position and second position.

In an embodiment, the cover further has a plurality of telescopic rods having opposite ends connected to the frame and the cylinder member; the telescopic rods are capable of changing lengths thereof to move the cover between the cylinder between the retracted position and the elevating position.

In an embodiment, the bag body has a sleeve and a tubular member connected to each other; the sleeve has an end connected to both the first member and the second member of the bottom; the tubular member is received in the sleeve and connected to the base.

In an embodiment, the tubular member is shorter than the sleeve, and the flexible portion is formed on the sleeve beyond the tubular member.

In an embodiment, the bag body further has a grip, and the grip is fixed to both the sleeve and the tubular member.

In an embodiment, the stand further has a linkage pivoted on the first member of the bottom and the legs respectively.

In an embodiment, the linkage has a middle portion and two parallel arms connected to opposite ends of the middle portion; the middle portion is received in the bag body and pivoted on the first member of the bottom; the arms extend out of the bag body and pivoted on legs respectively.

In an embodiment, the stand further has an elastic member having opposite ends connected to the base and the linkage to provide the legs a force for moving the legs to the third position from the fourth position.

In an embodiment, the first member of the bottom has an extending member, and the elastic member is connected to the extending member.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
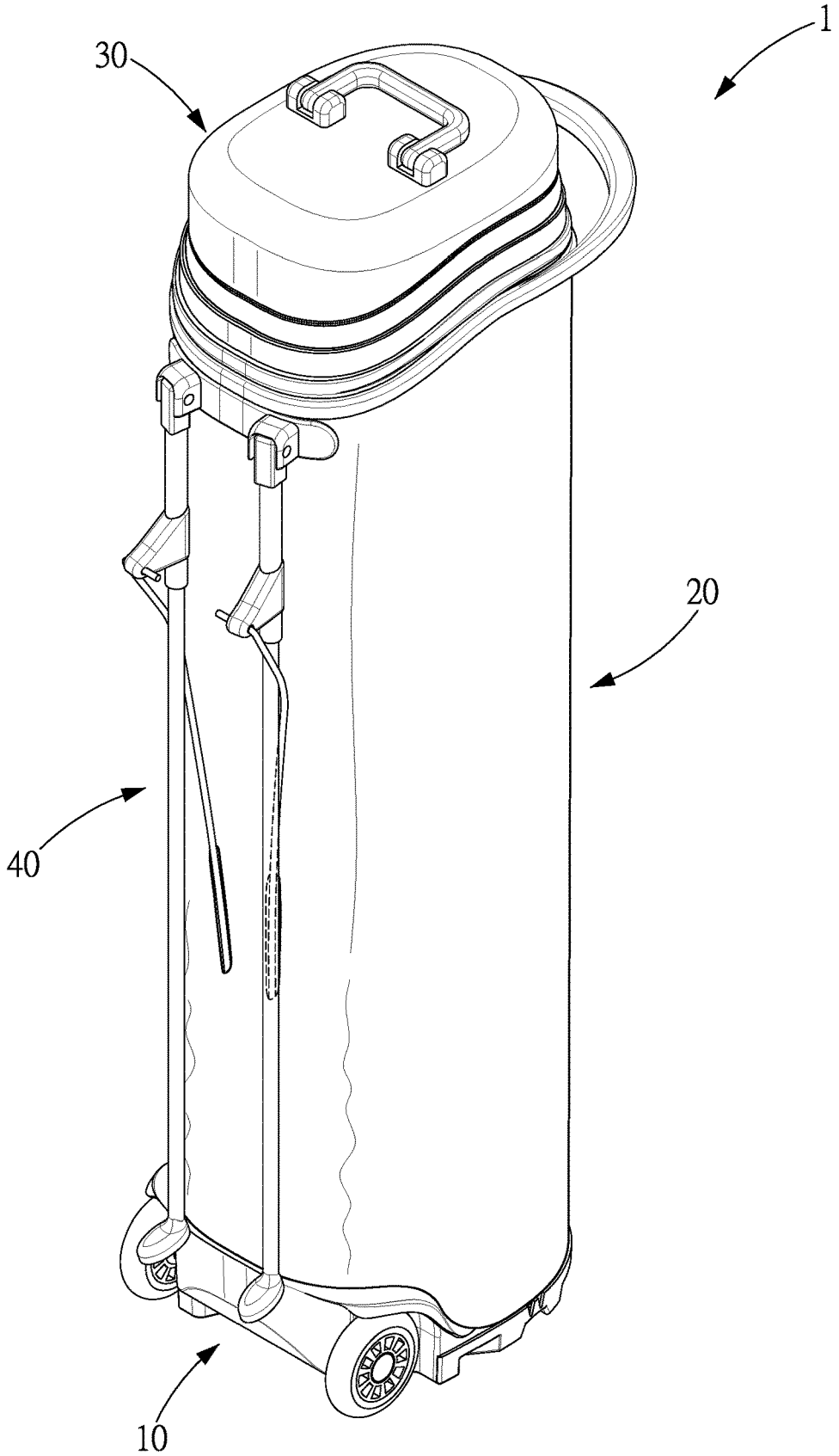
FIG. 1 is a perspective view of a preferred embodiment of the present invention.
Figure 2:
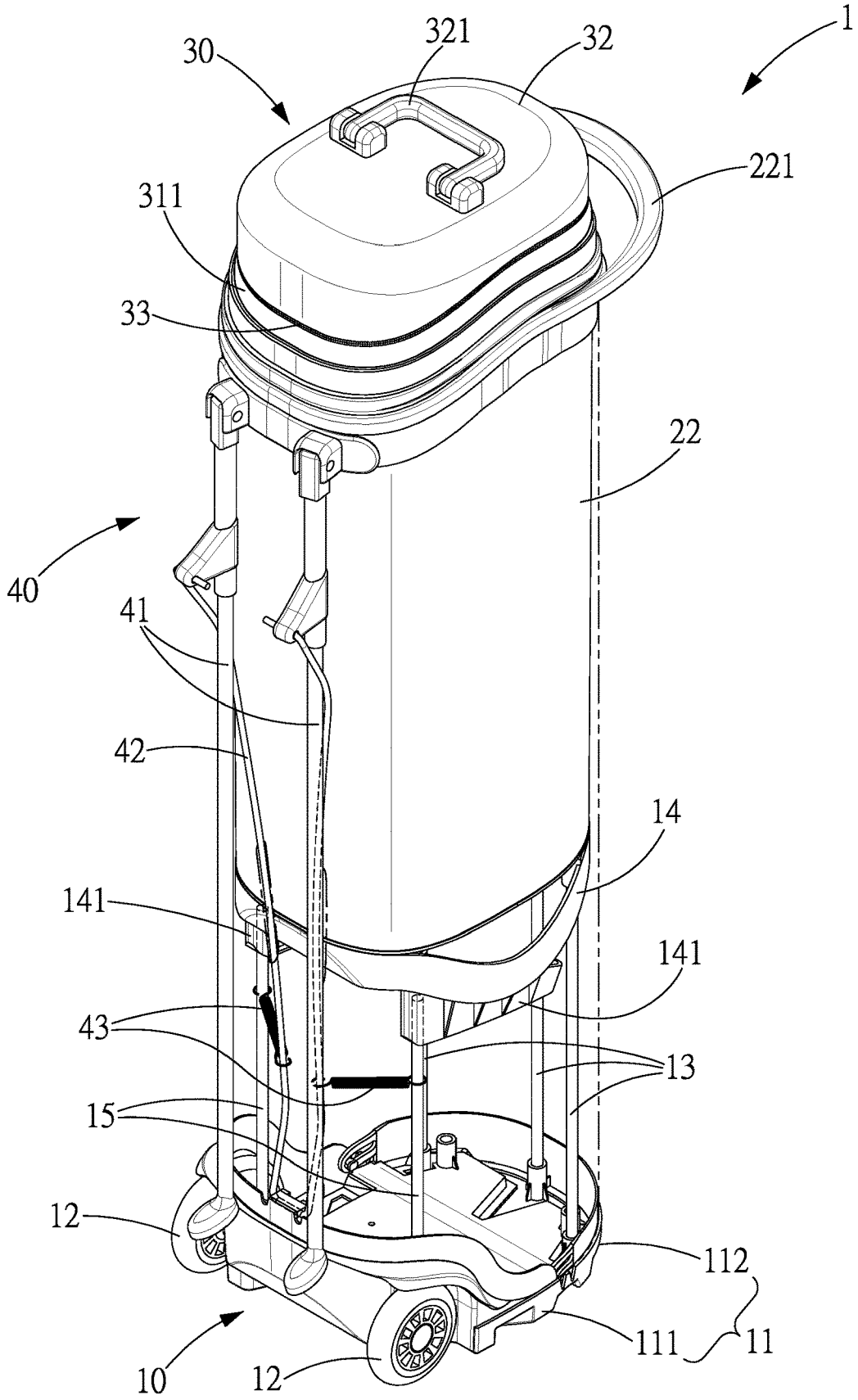
FIG. 2 is a perspective view of the preferred embodiment of the present invention, showing the sleeve being removed.
Figure 3:
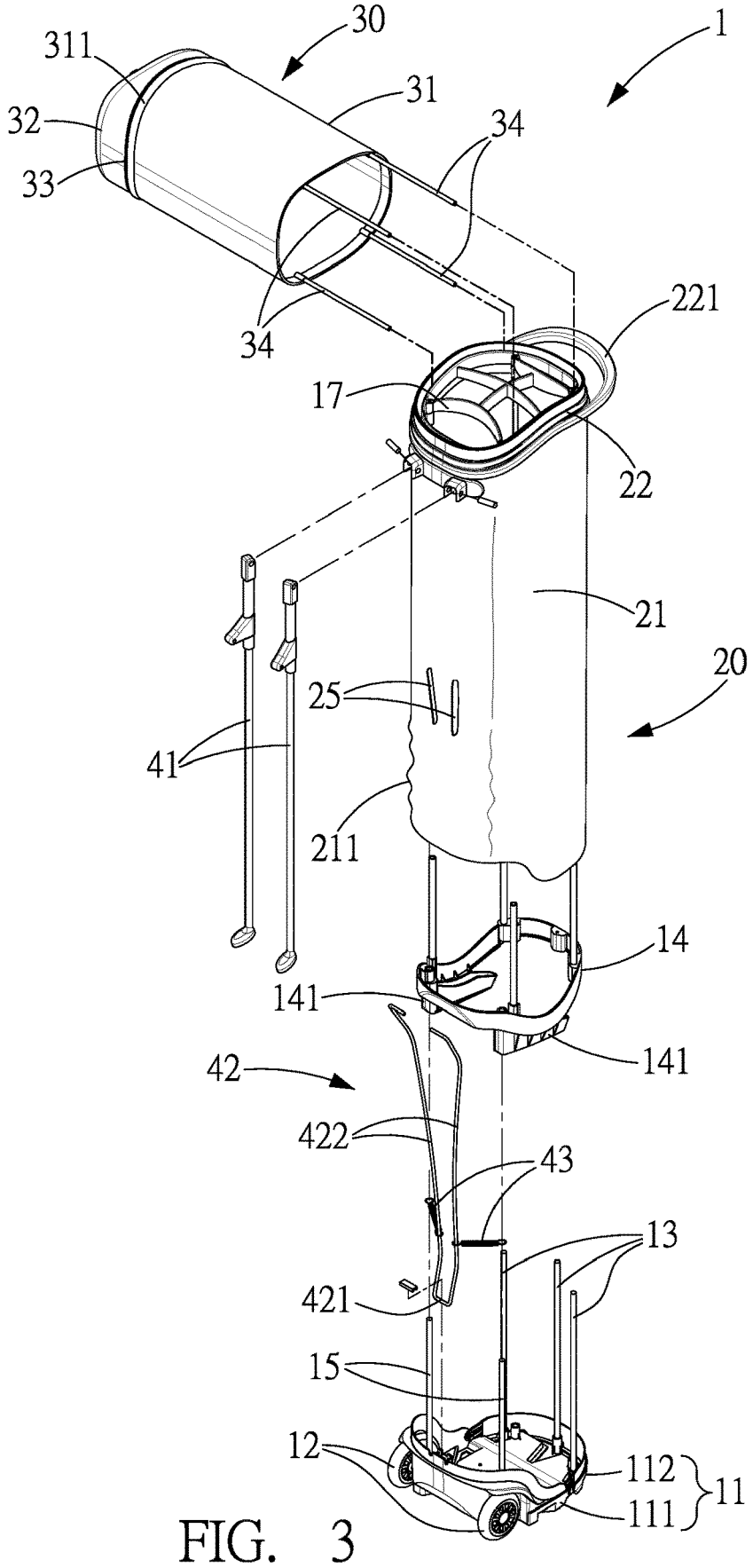
FIG. 3 is an exploded view of the preferred embodiment of the present invention.
Figure 4:
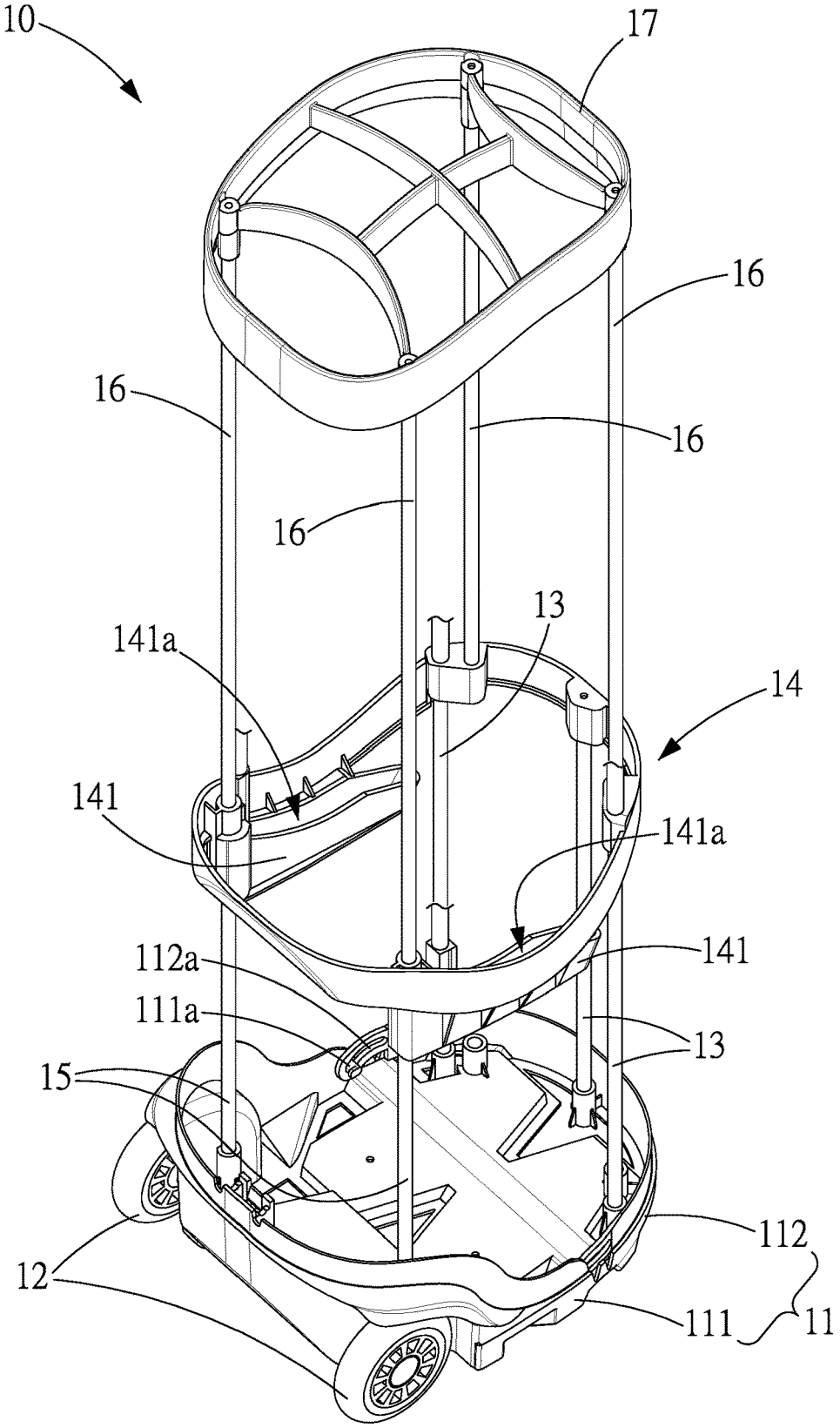
FIG. 4 is a perspective view of the base of the preferred embodiment of the present invention.
Figure 5:
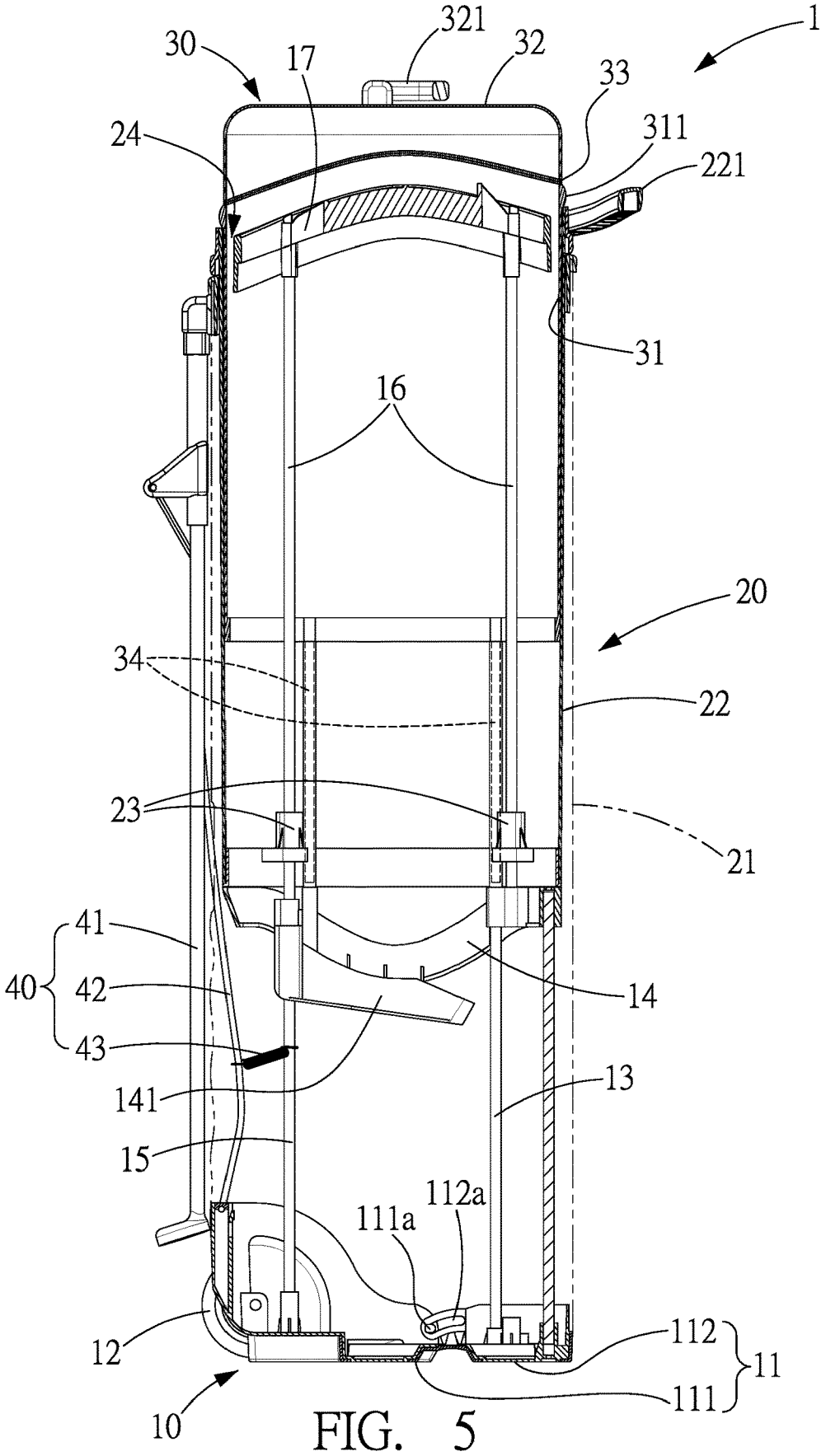
FIG. 5 is a sectional view of the preferred embodiment of the present invention.

As shown in FIG. 1, a golf bag 1 of the preferred embodiment of the present invention includes a base 10, a bag body 20, a cover 30 and a stand 40.

As shown in FIG. 2 to FIG. 5, the base 10 includes a bottom 11, two wheels 12, three first shafts 13, a frame 14, two extending members 15, four second shafts 16 and a divider 17. The bottom 11 has a first member 111 and a second member 112. The second member 112 has an end pivoted on the first member 111 with two pins 111*a* on the first member 111 engaging two curved slots 112*a* on the second member 112, so that the second member 112 is able to be turned relative to the first member 111 between a first position and a second position. In the first position, the second member 112 is parallel to the first member 111, and there is an included angle, which is less than 180 degrees, between the first member 111 and the second member 112 when the second member 112 is moved to the second position. The wheels 12 are pivoted on the first member 111. The first shafts 13 have opposite ends connected to the second member 112 of the bottom 11 and a bottom of the frame 14, so that the frame 14 is kept a predetermined distance above the bottom 11 and is moved with the second member 112. The frame 14 is a ring-like member, having two rails 141 above the first member 111 of the bottom 11. The extending members 15 are two shafts in the present embodiment, having ends connected to the first member 111 of the bottom 11, and opposite ends engaging the rails 141 respectively. In the present embodiment, each of the rails 141 has a slot 141*a* to receive the extending members 15, and the extending members 15 move in the slots 141*a* when the second member 112 is moved between the first position and the second position. The second shafts 16 have opposite ends connected to a top of the frame 14 and a bottom of the divider 17, so that the divider 17 is kept a predetermined distance above the frame 14.

The bag body 20 has a flexible sleeve 21 and a rigid tubular member 22. It is noted that the rigid means that the tubular member 22 is harder than the sleeve 21. The sleeve 21 has a bottom end connected to tops of the first member 111 and the second member 112 of the bottom 11, and most of the bottom 11 is left out of the sleeve 21. The sleeve 21 has a flexible portion 211 above the first member 111 to be flexed when the second member 112 is moved to the second position. The tubular member 22 is shorter than the sleeve 21 and is received in the sleeve 21 with a grip 221 fixed to tops of both the sleeve 21 and the tubular member 22. A plurality of connectors 23 are provided to connect the second shafts 16 to the tubular member 22, so that the bag body 20 is firmly connected to the base 10. A top of the divider 17 is substantially even with a top of the bag body 20, and an annular gap 24 is left between the divider 17 and the tubular member 22.

The cover 30 has a cylinder member 31 and a lid 32 connected to a top of the cylinder member 31 with a zip 33 to be opened and closed. The cylinder member 31 is received in the gap 24 between the divider 17 and the tubular member 22 to be reciprocated relative to the bag body 20. The cylinder member 31 has a protruding member 311 which surrounds the top periphery of the cylinder member 31, with its width bigger than the tubular member 22. Four telescopic rods 34 have opposite ends connected to the top of the frame 14 and an inner surface of the cylinder member 31. The telescopic rods 34 are capable of changing lengths thereof to assistant the reciprocation of the cover 30, so that the cover 30 is capable of being moved downward to an retracted position, in which most of the cylinder member 31 is received in the bag body 20, and a bottom end of the protruding member 311 is rested against the bag body 20, and moved upward to an elevating position, in which the lid 32 is kept a predetermined from the bag body 20. The lid 32 further has a second grip 321 on a top of the lid 32.

The stand 40 has two legs 41, a linkage 42, and two elastic members 43. The legs 41 have ends pivoted on the bag body 20 adjacent to the top thereof. The legs 41 are located at the same side with the first member 111 of the bottom 11. The legs 41 are movable between a third position, in which the legs 41 are attached to the bag body 20, and a fourth position, in which distal ends of the legs 41 are swung away from the bag body 20. The linkage 42 is a U-shaped bar in the present embodiment, with a middle portion 421 and two parallel arms 422 connected to opposite ends of the middle portion 421. The middle portion 421 is received in the bag body 20 and is pivoted on the first member 111 of the bottom 11. The arms 422 extend out of the bag body 20 via two bores 25 on the bag body 20 to pivot the legs 41 respectively. The elastic members 43 are springs in the present embodiment, having opposite ends connected to the extending members 15 and the arms 422 of the linkage 42 to force the legs 41 toward the third position. The linkage 42 and the elastic members 43 are capable of temporally holding the legs 41 in the third and the fourth positions respectively.

Figure 6:
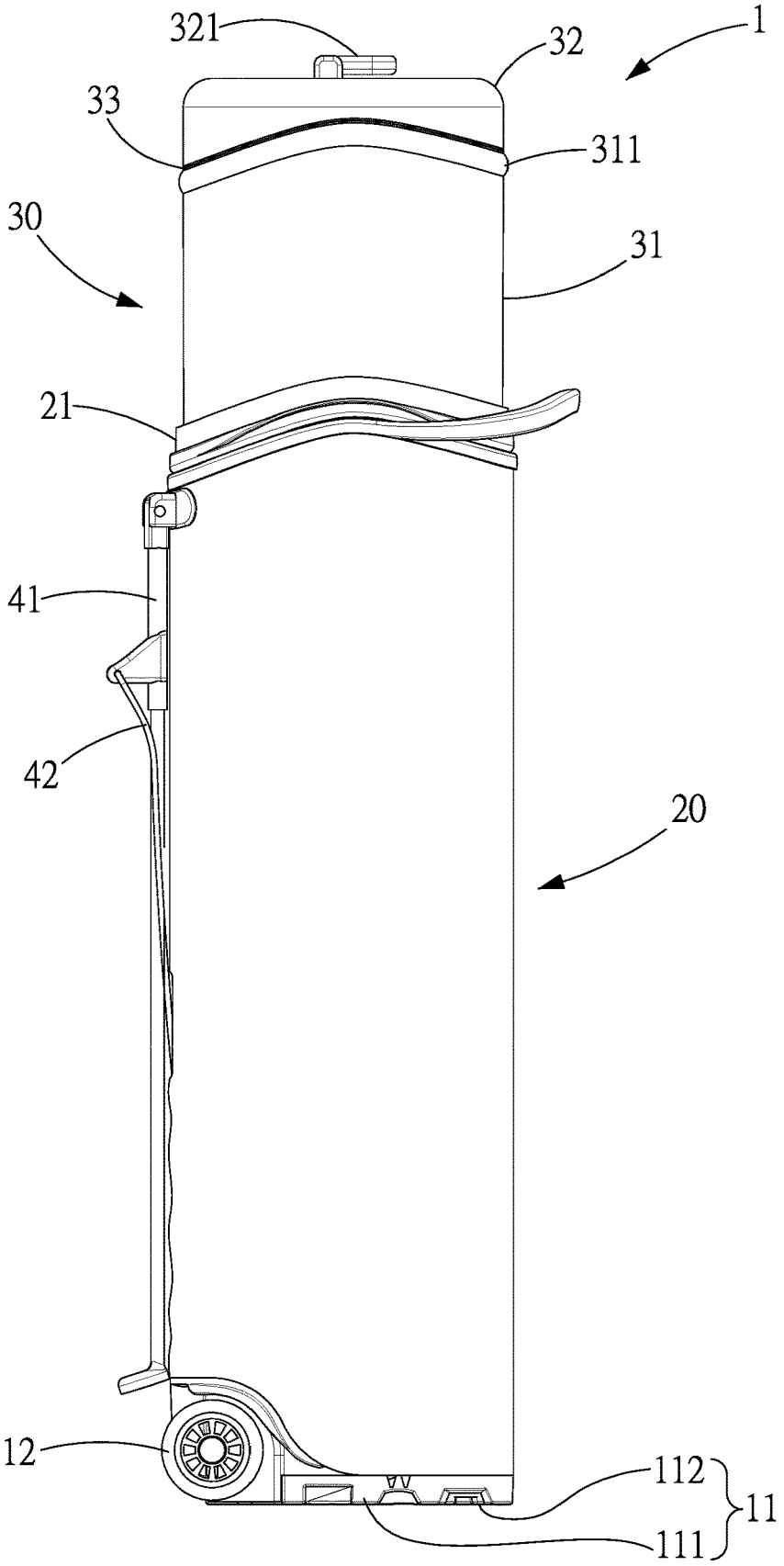
FIG. 6 is a side view of the preferred embodiment of the present invention, showing the golf bag at the straight status.
Figure 7:
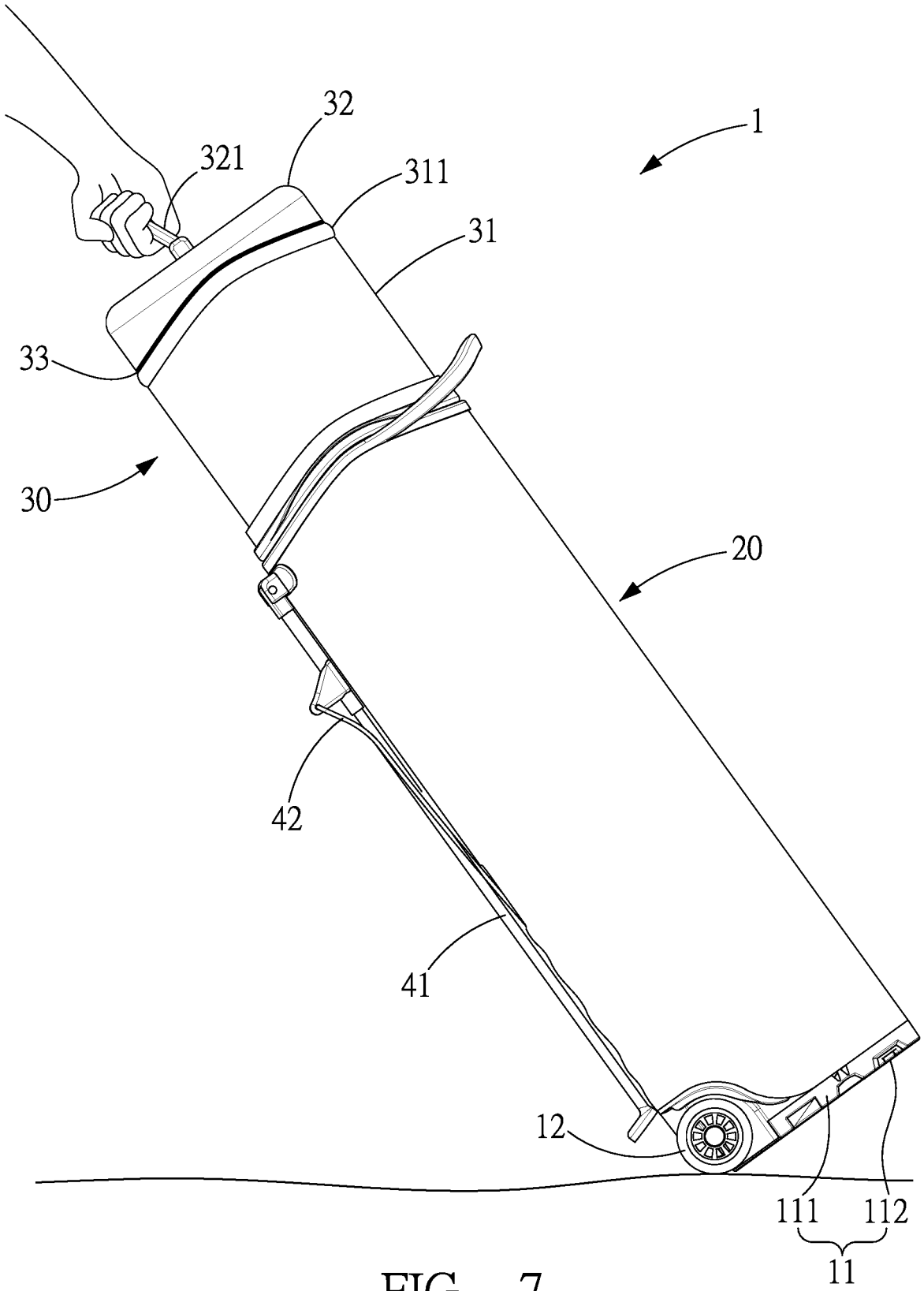
FIG. 7 is a side view of the preferred embodiment of the present invention, showing the golf bag being dragged to move.
Figure 8:
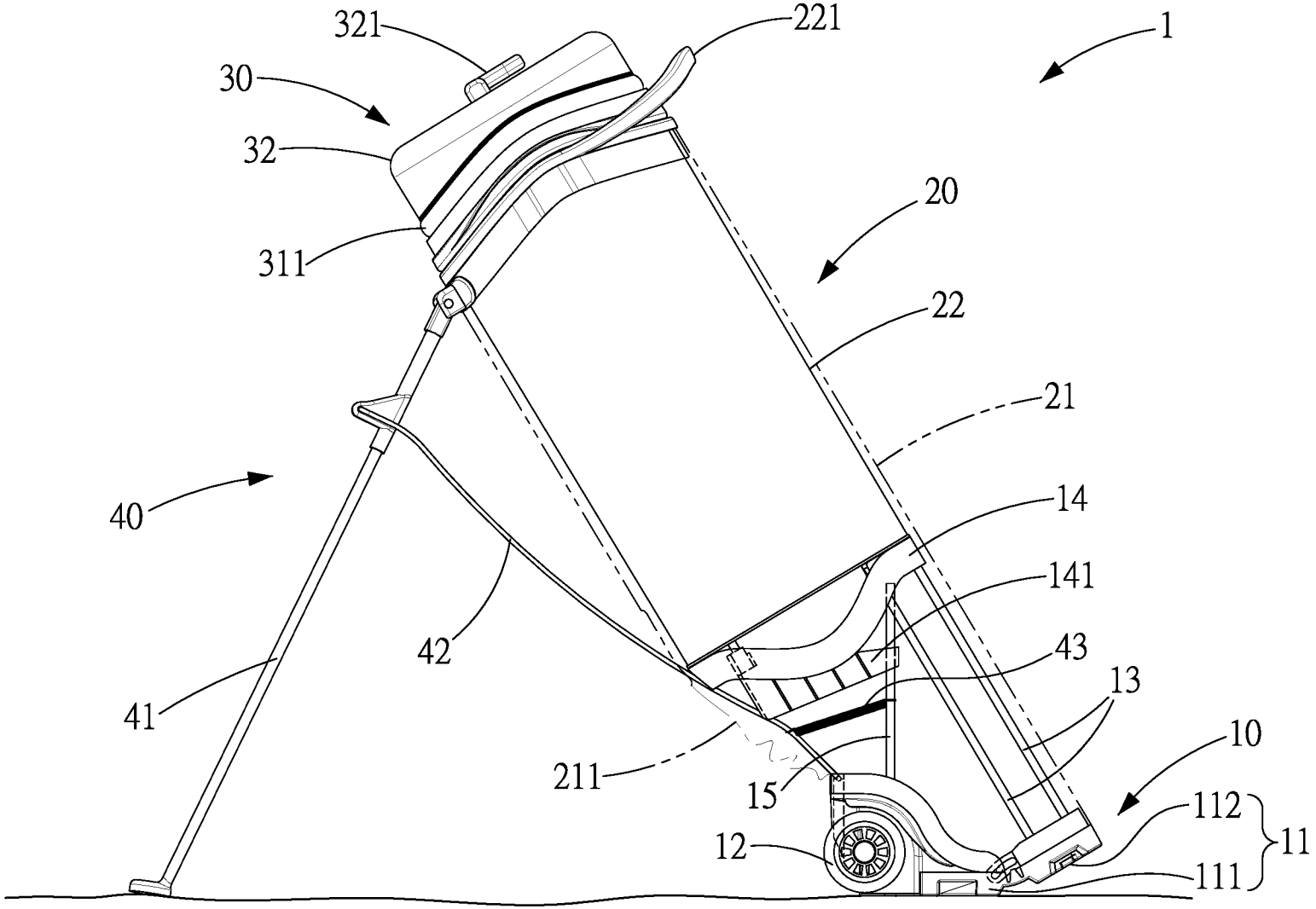
FIG. 8 is a side view of the preferred embodiment of the present invention, showing the golf bag at the lean status.

As shown in FIG. 6, the golf bag 1 of the embodiment of the present invention is at a straight status, in which the second member 112 is moved to the first position, the legs 41 are moved to the third position, and the cover 30 is moved to the elevating position. In the straight status, both the first member 111 and the second member 112 touch the ground, and the wheels 12 are off the ground to let the golf bag 1 stand straightly on the ground. A golfer may hold the second grip 321 and lean the golf bag 1, as shown in FIG. 7, to draw the golf bag 1 and walk in the field. When the golfer arrives at the location of a ball, he/she may pull the legs 41 to the fourth position and bend the golf bag 1 to have the second member 112 moved to the second position to change the golf bag 1 to a leaning status as shown in FIG. 8. In the leaning status, the second member 112 is off the ground, and the first member 111 and the distal ends of the legs 41 touch the ground. The cover 30 will move to the retracted position automatically because of gravity when the lid 32 is unzipped. It is clear that a top opening of the bag body 20 is leaned from the vertical line, and the golfer may pick any golf clubs in the golf bag 1 to swing.

It must be pointed out that the embodiments described above are only some preferred embodiments of the present invention. All equivalent structures which employ the concepts disclosed in this specification and the appended claims should fall within the scope of the present invention.

What is claimed is:

1. A golf bag, comprising:

a base having a bottom and a divider, wherein the bottom has a first member and a second member, and the second member is pivoted relative to the first member to be turned between a first position, in which the second member is substantially parallel to the first member, and a second position in which an included angle, which is less than 180 degrees, is formed between the first and the second members; the divider is connected to the second member of the bottom to be kept a predetermined distance above the bottom and moved with the second member;

a bag body has an end connected to the bottom of the base, wherein the bag body has a flexible portion above the first member to be flexed when the second member is moved to the second position; an annular gap is formed between the bag body and the divider;

a stand having two legs pivoted relative to the bag body, wherein the legs are moved between a third position, in which the legs are attached to the bag body, and a fourth position, in which distal ends of the legs are swung away from the bag body;

wherein the golf bag is switchable between a straight status, in which the second member is moved to the first position, and a leaning status, in which the second member is moved to the second position and the legs are moved to the fourth position to have the distal ends of the legs and the first member of the bottom touching the ground; and a cover having a cylinder member and a lid, wherein the lid is connected to a top of the cylinder member to be opened and closed; the cylinder member is received in the gap between the bag body and the divider for reciprocation between a retracted position, in which the lid is moved toward the bag body, and an elevating position, in which the lid is moved away from the bag body.

2. The golf bag of claim 1, wherein the base further has a frame between the bottom and the divider, and the frame is connected to the divider and the second member of the bottom respectively, so that both the divider and the frame are moved with the second member.

3. The golf bag of claim 2, wherein the cylinder member of the cover rests against the frame when the cylinder member is moved to the retracted position.

4. The golf bag of claim 2, wherein the flexible portion of the bag body is formed between the frame and the base.

5. The golf bag of claim 2, wherein the frame is connected to the second member of the bottom via a plurality of first shafts, and is connected to the divider via a plurality of second shafts.

6. The golf bag of claim 2, wherein the frame is provided with a rail, and an extending member is connected to the first member of the bottom and engages the rail, so that the extending member is moved along the rail when the second member is moved between the first position and second position.

7. The golf bag of claim 2, wherein the cover further has a plurality of telescopic rods having opposite ends connected to the frame and the cylinder member; the telescopic rods are capable of changing lengths thereof to move the cover between the cylinder between the retracted position and the elevating position.

8. The golf bag of claim 1, wherein the bag body has a sleeve and a tubular member connected to each other; the sleeve has an end connected to both the first member and the second member of the bottom; the tubular member is received in the sleeve and connected to the base.

9. The golf bag of claim 8, wherein the tubular member is shorter than the sleeve, and the flexible portion is formed on the sleeve beyond the tubular member.

10. The golf bag of claim 8, wherein the bag body further has a grip, and the grip is fixed to the sleeve.

11. The golf bag of claim 1, wherein the stand further has a linkage pivoted on the first member of the bottom and the legs respectively.

12. The golf bag of claim 11, wherein the linkage has a middle portion and two parallel arms connected to opposite ends of the middle portion; the middle portion is received in the bag body and pivoted on the first member of the bottom; the arms extend out of the bag body and pivoted on legs respectively.

13. The golf bag of claim 11, wherein the stand further has an elastic member having opposite ends connected to the base and the linkage to provide the legs a force for moving the legs to the third position from the fourth position.

14. The golf bag of claim 13, wherein the first member of the bottom has an extending member, and the elastic member is connected to the extending member.

* * * * *